US011119449B2

(12) United States Patent
Tanabe

(10) Patent No.: US 11,119,449 B2
(45) Date of Patent: Sep. 14, 2021

(54) ELECTRONIC TIMEPIECE

(71) Applicant: Seiko Epson Corporation, Tokyo (JP)

(72) Inventor: Takuya Tanabe, Shiojiri (JP)

(73) Assignee: Seiko Epson Corporation

( * ) Notice: Subject to any disclaimer, the term of this patent is extended or adjusted under 35 U.S.C. 154(b) by 882 days.

(21) Appl. No.: 15/789,140

(22) Filed: Oct. 20, 2017

(65) Prior Publication Data

US 2018/0120774 A1 May 3, 2018

(30) Foreign Application Priority Data

Nov. 1, 2016 (JP) ..... JP2016-214437

(51) Int. Cl.
*G04R 20/00* (2013.01)
*G04R 20/12* (2013.01)
*G04R 20/10* (2013.01)

(52) U.S. Cl.
CPC ..... *G04R 20/00* (2013.01); *G04R 20/10* (2013.01); *G04R 20/12* (2013.01)

(58) Field of Classification Search
CPC ..... G04R 20/00; G04R 20/12; G04R 20/10; G04R 20/08; G04R 40/06; H04L 27/06; G06F 11/10; G04G 7/02
USPC ..... 368/47
See application file for complete search history.

(56) References Cited

U.S. PATENT DOCUMENTS 7,903,501 B2 * 3/2011 Fujisawa ..... G04R 20/10 368/47
8,264,915 B2 * 9/2012 Abe ..... G04R 20/10 368/47
2009/0274011 A1 * 11/2009 Fujisawa ..... G04R 20/10 368/47
2011/0075523 A1 * 3/2011 Abe ..... G04R 20/10 368/47

FOREIGN PATENT DOCUMENTS

JP 2012-163541 A 8/2012

* cited by examiner

*Primary Examiner* — Stephanie E Bloss
(74) *Attorney, Agent, or Firm* — Harness, Dickey & Pierce, P.L.C.

(57) ABSTRACT

The electronic timepiece has a receiver that receives standard time signals; a detector that samples the received signal and detects the signal level; a calculator that computes, based on the detected signal level, the total signal width of a first level signal in 1-second, and the continuous time of the second level signal; and a code evaluator that determines the code transmitted in the signal based on the calculated total. The signal contains a first code and a second code in which the total signal width of the first level signal in 1 second is the same; the first code is a code that transmits the first level signal in 1 second; the second code is a code that transmits two first level signals separated by a second level signal in 1 second.

2 Claims, 13 Drawing Sheets

TIME CODE TABLE

| | 0 | 1 | 2 | 3 | 4 | 5 | 6 | 7 | 8 | 9 | 10 | 11 | 12 | 13 | 14 | 15 | 16 | 17 | 18 | 19 |
|---|---|---|---|---|---|---|---|---|---|---|---|---|---|---|---|---|---|---|---|---|
| bitA | M | 0 | 0 | 0 | 0 | 0 | 0 | 0 | 0 | 0 | 0 | 0 | 0 | 0 | 0 | 0 | 0 | YY | YY | YY |
| bitB | M | D | D | D | D | D | D | D | D | D | D | D | D | D | D | D | D | 0 | 0 | 0 |
| | 20 | 21 | 22 | 23 | 24 | 25 | 26 | 27 | 28 | 29 | 30 | 31 | 32 | 33 | 34 | 35 | 36 | 37 | 38 | 39 |
| bitA | YY | YY | YY | YY | YY | MM | MM | MM | MM | MM | DM | DM | DM | DM | DM | DM | DW | DW | DW | H |
| bitB | 0 | 0 | 0 | 0 | 0 | 0 | 0 | 0 | 0 | 0 | 0 | 0 | 0 | 0 | 0 | 0 | 0 | 0 | 0 | 0 |
| | 40 | 41 | 42 | 43 | 44 | 45 | 46 | 47 | 48 | 49 | 50 | 51 | 52 | 53 | 54 | 55 | 56 | 57 | 58 | 59 |
| bitA | H | H | H | H | H | M | M | M | M | M | M | M | 0 | 1 | 1 | 1 | 1 | 1 | 1 | 0 |
| bitB | 0 | 0 | 0 | 0 | 0 | 0 | 0 | 0 | 0 | 0 | 0 | 0 | 0 | CH | P | P | P | P | ST | 0 |

FIG. 3

ELECTRONIC TIMEPIECE

BACKGROUND

1. Technical Field

The present invention relates to an electronic timepiece that receives a standard time signal transmitting information using a combination of two data bits in a 1-second signal.

2. Related Art

A standard time signal generally carries three types of signals, 0, 1, and P or M, in signals transmitted at a 1-second interval. In contrast, the MSF time signal transmitted in the UK carries two data bits, bit A and bit B, in each 1-second signal. As a result, the MSF signal transmits a total of five signal wave patterns, including four combinations of two bits and a marker. There are four possible combinations of the two bits A and B: 00, 01, 10, 11.

To determine the time code transmitted in an MSF signal, JP-A-2012-163541 proposes previously setting five signal-level evaluation periods A to E each second, detecting if the received signal level is High or Low in each evaluation period, and identifying the five signal wave patterns based on the combination of High and Low levels in the five evaluation periods.

However, because JP-A-2012-163541 evaluates the signal level in five signal level evaluation periods, and then identifies the time code by the resulting combination of High and Low signals, processing is complicated.

As a result, we studied a simplified evaluation method of identifying the time code from the total width of the High level signal pulses in one second when the signal level changes from Low to High at the second (synchronization) marker.

However, in an MSF signal of bit A=1, bit B=0 transmitting a 200 ms High level signal, and a signal of bit A=0, bit B=1 carrying two 100-ms High level signals separated by a 100-ms Low pulse, both signals have a total High level signal width of 200 ms, and cannot be differentiated by this simplified method.

In a standard time signal transmitting a time code by a signal that changes between a first level (such as High) and a second level (such as Low), the total signal width of first level signals in one second is the same as in the MSF signal, and the same problem is presented by standard time signals carrying two types of signals with different wave patterns.

SUMMARY

An objective of the invention is to provide an electronic timepiece that simplifies the process of evaluating the time code when receiving a standard time signal that transmits information using a combination of two data bits in a 1-second signal.

An electronic timepiece according to the invention includes: a receiver that receives a standard time signal, which carries a first level signal and a second level signal in 1 second, and transmits a signal containing first data bit and second data bit in the 1 second by a combination of the first level signal and second level signal; a detector that samples the signals received by the receiver and detects the signal level; a calculator that, based on the signal levels detected by the detector, calculates the total signal width of the first level signal, and the continuous time of the second level signal, in 1 second; and a code evaluator that determines the code of the signal based on the total calculated by the calculator. The signal contains a first code and a second code in which the total signal width of the first level signal in 1 second is the same; the first code is a code that transmits the first level signal in 1 second; the second code is a code that transmits two first level signals separated by a second level signal in 1 second; and the detector stops sampling the signal of 1 second when the continuous time is greater than or equal to a previously set reference time.

For example, in an MSF signal, the first data bit is bit A and the second data bit is bit B. The first code is equal to a signal of bit A=1, bit B=0, and the second code is equal to a signal of bit A=0, bit B=1. In a signal of bit A=1, bit B=0, the first level signal is transmitted for 200 ms. In a signal of bit A=0, bit B=1, two 100-ms first level signals are transmitted separated by a 100-ms second level signal.

The reference time is set to a time enabling differentiating a Low level signal from noise. More specifically, the reference time is set to a time longer than the signal width of anticipated noise, such as 50 ms.

As a result, when a signal of the second code is received, the detector, after receiving the first of two first level signals, stops sampling while the second level signal is being received. Note that the detector stops sampling until the signal of the next second is detected. In this case, the calculator calculates the total signal width of the first first-level signal. More specifically, the signal width of the second first level signal is not included in the total signal width.

As a result, when a signal of the second code is received, the total calculated by the calculator is shorter than the total when a signal of the first code is received. The code evaluator can therefore differentiate the first code and second code based on the calculated total.

Therefore, this aspect of the invention can determine the code based on the total signal width of the first level signal, and simplifies processing compared with a configuration that evaluates the signal level in five signal level evaluation periods, and evaluates the code based on the combination of detected signal levels.

For example, in an MSF signal of frames comprising signals transmitted over a 60-second period, time information is carried in bit A of seconds 17 to 51. As a result, if the value of bit A can be acquired, the time can be corrected. Ignoring the value of bit B and evaluating only the value of bit A is therefore conceivable.

When a signal of bit A=0, bit B=1 is transmitted in this aspect of the invention, the detector stops detecting the signal level while receiving a 100-ms second level signal after receiving the first first-level signal of 100 ms, and therefore does not detect the second 100-ms first level signal. As a result, the calculated total is the same 100 ms as when a signal of bit A=0, bit B=0 is received, and the code evaluator can determine the value of bit A is 0.

However, when a signal of bit A=1, bit B=0 is transmitted, the detector continues detecting the signal level at least until transmission of the first level signal ends. As a result, the calculated total is 200 ms, the code evaluator can differentiate the signal from a signal of bit A=0, bit B=1, and can determine that the value of bit A in the signal is 1.

When a signal of the second code is received, the detector stops sampling before the second first level signal is received, and can therefore reduce power consumption compared with a configuration that continues sampling until all of the second first level signal is received.

In an electronic timepiece according to another aspect of the invention, the code evaluator detects a signal position indicating which second the signal represents in a frame including signals for a 60-second period; and the receiver stops the reception process when at a signal position not containing information to acquire.

In this aspect of the invention, the code evaluator detects the position of second 00 by detecting a second marker, and thereafter can detect each second position. The signal position enabling acquiring specific information, such as time information, can also be obtained based on the type of standard time signal received. As a result, by stopping the reception process other than at the signal position, power consumption can be reduced compared with executing the reception process at all signal positions.

An electronic timepiece according to another aspect of the invention includes: a receiver that receives a standard time signal, which carries a first level signal and a second level signal in 1 second, and transmits a signal containing first data bit and second data bit in the 1 second by a combination of the first level signal and second level signal; a detector that samples the signals received by the receiver and detects the signal level; a calculator that, based on the signal levels detected by the detector, calculates the total signal width of the first level signal, and the continuous second level signal time, in 1 second; and a code evaluator that evaluates the code of the signal, and detects a signal position indicating which second the signal represents in a frame including signals for a 60-second period. The signal contains a first code, second code, and third code; the total signal width of the first level signal in 1 second is the same in the first code and the second code; the first code is a code that transmits the first level signal in 1 second; the second code is a code that transmits two first level signals separated by a second level signal in 1 second, the values of the first data bit and the second data bit each being different from the values in the first code; the third code transmits, in 1 second, one first-level signal of the same signal width as the first first-level signal of the two first-level signals in the second code, the value of the first data bit being the same as the second code, and the value of the second data bit being different from the second code; at a signal position where the information to acquire is contained in the first data bit, the detector stops sampling signals in the 1 second when the continuous time is greater than or equal to a previously set reference time, and the code evaluator determines the value of the first data bit based on the total calculated by the calculator; and at a signal position where the first data bit is a fixed value, and the information to acquire is contained in the second data bit, the detector continues sampling until the previously set stop-sampling time, and the code evaluator determines the value of the second data bit based on the total calculated by the calculator and the signal position.

In an MSF signal, the third code is a signal of bit A=0, bit B=0. A 100-ms first level signal is transmitted in a signal of bit A=0, bit B=0.

At a signal position where the information to acquire is contained in the first data bit, and a signal of the second code is received, the detector in this aspect of the invention stops sampling while the second level signal is being received after the first first-level signal is received. As a result, the total calculated when the second code signal is received is the signal width of the first first-level signal, and is shorter than the total when a signal of the first code is received. As a result, the code evaluator can differentiate the first code and the second code based on the total signal width.

Because the total of the second code is the same as the total of the third code, the code evaluator cannot differentiate the second code and the third code. However, because the value of the first data bit is the same in the second code and third code, the value of the first data bit can be determined even if the second code and third code cannot be differentiated.

The value of the first data bit can therefore be acquired at a signal position carrying the information to acquire in the first data bit.

Because the value of the second data bit is different in the second code and third code, the value of the second data bit cannot be determined.

In this aspect of the invention, the detector therefore continues sampling to the stop-sampling time at a signal position where the first data bit is fixed and the information to acquire is carried in the second data bit. Because the calculated total is the same in the first code and second code in this case, the first code and second code cannot be differentiated based on the signal width. As a result, this aspect of the invention differentiates the first code and second code based on the signal position. That is, because the value of the first data bit is different in the first code and second code, at a signal position where the value of the first data bit is fixed, the first code and second code can be differentiated based on the signal position. Furthermore, because the calculated total is different, the third code can be differentiated from the first code and second code based on the total.

The value of the second data bit can therefore be acquired at a signal position where the first data bit is a fixed value, and the information to acquire is carried in the second data bit.

This aspect of the invention can therefore determine the value of the first data bit and the second data bit based on the total signal width of first level signals and the signal position, and simplifies processing compared with a configuration that evaluates the signal level in five signal level evaluation periods, and evaluates the code based on the combination of detected signal levels.

In an electronic timepiece according to another aspect of the invention, the detector stops sampling when the continuous time in the evaluation period set according to the start-transmission time of the second level signal between the two first level signals in the second code is greater than or equal to the reference time.

In this aspect of the invention, the detector does not stop sampling when the continuous second level signal time exceeds a reference time and noise is thereby detected during the first level signal transmission period before the evaluation period. Compared with a configuration that does not set an evaluation period, this aspect of the invention reduces the possibility of being unable to evaluate the code due to noise.

An electronic timepiece according to another aspect of the invention includes: a receiver that receives a standard time signal, which carries a first level signal and a second level signal in 1 second, and transmits a signal containing first data bit and second data bit in the 1 second by a combination of the first level signal and second level signal; a detector that samples the signals received by the receiver and detects the signal level; and a code evaluator that evaluates the code of the signal, and detects a signal position indicating which second the signal represents in a frame including signals for a 60-second period. The standard time signal includes a first period in which the signal level changes according to the value of the first data bit, and a second period in which the signal level changes according to the value of the second data bit; the signal includes a first code and a second code; the first code transmits the first level signal in the first period, and transmits the second level signal in the second period;

the second code transmits the second level signal in the first period, and transmits the first level signal in the second period; and the code evaluator selects either the first period or the second period according to the signal position, and evaluates the code of the signal based on the signal level detected in the selected period.

At a signal position where the information to acquire is carried in the first data bit in a 1-second signal, the code evaluator can determine the value of the first data bit based on the signal level detected during a first transmission period. At a signal position where the information to acquire is carried in the second data bit, the code evaluator can determine the value of the second data bit based on the signal level detected during a second transmission period.

The invention can therefore determine the values of the first data bit and second data bit based on the signal levels detected in a first period or second period, and simplifies processing compared with a configuration that evaluates the signal level in five signal level evaluation periods, and evaluates the time code based on the combination of detected signal levels.

In an electronic timepiece according to another aspect of the invention, the detector stops sampling in other periods when either the first period or the second period is selected by the code evaluator.

This aspect of the invention reduces power consumption compared with a configuration in which the detector always samples the first period and second period.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 3 describes the time code format of the MSF broadcast signal in the UK.

DESCRIPTION OF EMBODIMENTS

Embodiment 1

A first embodiment of the present invention is described below with reference to the accompanying figures.

Electronic Timepiece Configuration

Figure 1:
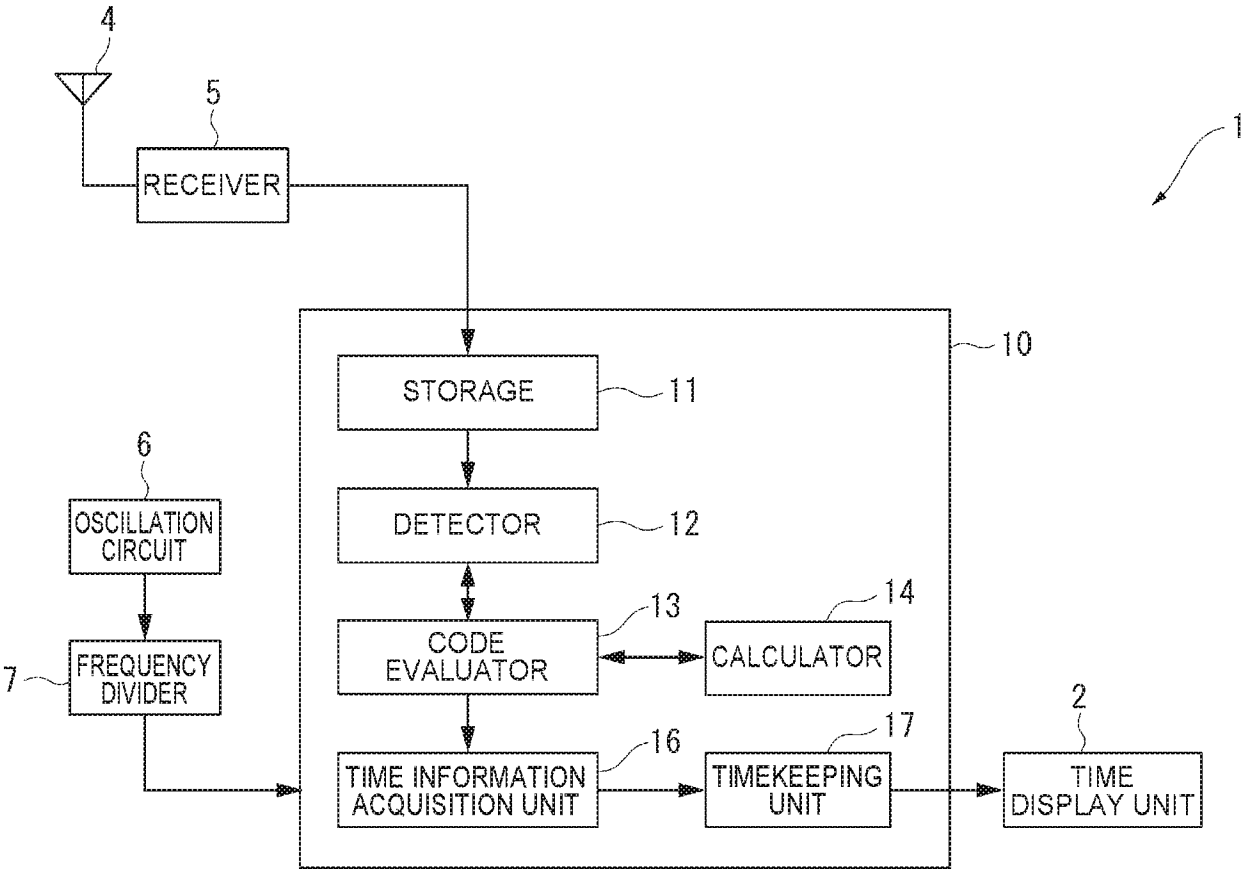
FIG. 1 is a block diagram illustrating the configuration of an electronic timepiece according to a first embodiment of the invention.

FIG. 1 is a block diagram illustrating the internal configuration of an electronic timepiece 1.

The electronic timepiece 1 is a radio-controlled timepiece capable of receiving the MSF standard time signal transmitted in the UK, and includes a time display unit 2 for displaying the time, a receiver 5 for receiving signals carrying time information using an antenna 4, an oscillation circuit 6 and a frequency divider 7 as a reference signal source that outputs outputting a reference signal, and a controller 10 that controls operation of the electronic timepiece 1.

The time display unit 2 includes hands such as typically used in an analog timepiece, an indicator (date wheel, day wheel) imprinted with date or weekday markers, and a motor and wheel train(s) for driving the foregoing. More specifically, the time display unit includes, not shown in the figures, a dial, hour, minute, and second hands, and calendar wheels such as a date and day wheels indicating the date or weekday.

Note that either of the date and day wheels may be provided, neither provided, or both provided. Which are provided may be determined based on the design of the timepiece and other considerations.

The motor(s) is typically a stepper motor, but may be configured with another drive mechanism, such as a piezoelectric actuator, capable of moving the hands.

The time display unit 2 is not limited to configurations including hands or a calendar wheel and may be configured with an LCD, OLED, or other type of display device.

The antenna 4 is a common antenna, such as a patch antenna able to receive standard time signals, that can be incorporated in the electronic timepiece 1.

The receiver 5 is configured similarly to a receiver circuit connected to the antenna 4 for receiving common standard time signals, and includes a turning circuit, not shown, comprising a tuning capacitor, for example.

While not shown in the figures, the receiver 5 includes a first amplifier, bandpass filter, second amplifier, envelope detector, AGC (Auto Gain Control) circuit, and digitizer. The first amplifier adjusts the gain according to the signal (AGC voltage) input from the AGC circuit described below to input the signal received from the tuning circuit at a specific amplitude to the bandpass filter. The bandpass filter is a filter that extracts signals in a desired frequency band.

More specifically, the carrier wave component is removed from the received signal input from the first amplifier by passing through the bandpass filter. The second amplifier then amplifies by a specific gain the received signal input from the bandpass filter. The envelope detector comprises a rectifier not shown and a low-pass filter (LPF) not shown, rectifies and filters the received signal input from the second amplifier, and outputs the filtered envelope signal to the AGC circuit and digitizer.

Based on the envelope signal input from the envelope detector, the AGC circuit outputs a signal that determines the gain when the first amplifier amplifies the received signal.

The digitizer compares the envelope signal input from the envelope detector with a reference voltage (threshold), and outputs a digital signal, that is, TCO (Time Code Out) signal.

As a result, the receiver 5 converts the received standard time signal to a digital TCO signal output to the controller 10.

Because the standard time signal carries an amplitude modulated signal, there are periods of great modulation and periods of little modulation. Based on the change in modulation, the receiver 5 digitizes the signal level of the received signal as a High level or Low level, and outputs the result as the digital TCO signal. When the amplitude is high, the received signal may be output as a High level or a Low level by the configuration of the receiver 5. As a result, the received signal changes from the first level to the second level during a 1-second period, but the first level may be High or Low, and the second level is a different level than the first level. Because the receiver 5 in this embodiment of the invention outputs a TCO signal that rises from the Low level to the High level at the start of each second (at the second marker), the first level is set High and the second level is set Low.

The receiver 5 is controlled by the controller 10, and is configured to receive through the antenna 4 standard time signals at a frequency set by a tuning circuit.

Note that the frequency of the standard time signal is set according to the type of time signal to receive. To receive at least MSF broadcasts in the UK, the electronic timepiece 1 according to this embodiment is set to receive time signals at 60 kHz. Note that the electronic timepiece 1 may also be configured to receive time signals other than MSF broadcasts, and the frequency is set appropriately to the time signal to receive.

For example, the reception frequency is set to 40 kHz or 60 kHz if the receiver 5 is to receive the JJY standard time signal transmitted in Japan; to 60 kHz to receive the WWVB time signal transmitted in the United States; 77.5 kHz to receive the DCF77 time signal in Germany; and 68.5 kHz to receive the BPC time signal in China.

The time signal may be selected manually by the user, or automatically by the electronic timepiece 1 automatically changing the reception frequency according to the location, for example.

MSF Broadcasts in the UK

The MSF signal broadcast in the UK is described next.

Figure 2:
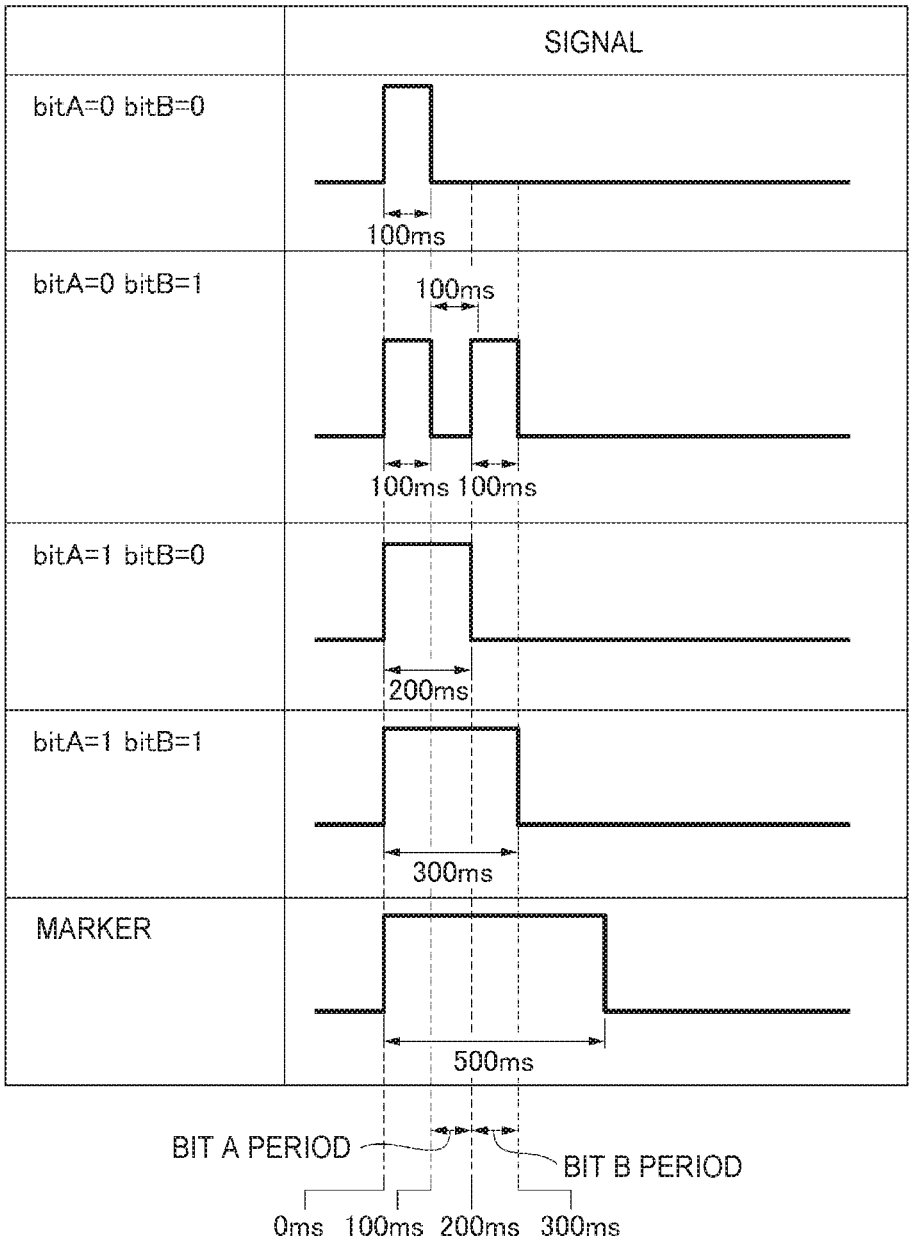
FIG. 2 illustrates the signal pattern of the MSF broadcast signal in the UK.

As shown in FIG. 2, the MSF signal may transmit a signal of any of five signal wave patterns each second to differentiate between a marker and four possible combinations of bit A (first data bit) and bit B (second data bit). Each signal rises from the Low level (second level) to High level (first level) at the beginning of each second (at the second marker), and is a signal of five signal wave patterns in which the signal width of the High level signal (first level signal) differs.

If bit A=0 and bit B=0, the signal is High for 100 ms from the start of the second (second marker; 0 ms), and Low for the remaining 900 ms of the second. The total High level signal width is therefore 100 ms.

If bit A=0 and bit B=1, the signal is High for 100 ms from the start of the second, Low for the next 100 ms, High for the next 100 ms, and then Low for the remaining 700 ms of the second. In other words, two High level signals are transmitted in 1 second, and the total High level signal width is 200 ms.

If bit A=1 and bit B=0, the signal is High for 200 ms from the start of the second, and Low for the remaining 800 ms of the second. The total High level signal width is therefore 200 ms.

If bit A=1 and bit B=1, the signal is High for 300 ms from the start of the second, and Low for the remaining 700 ms of the second. The total High level signal width is therefore 300 ms.

When a marker is transmitted, the signal is High for 500 ms from the start of the second, and Low for the remaining 500 ms of the second. The total High level signal width is therefore 500 ms.

When bit A=0 and bit B=1, and when bit A=1 and bit B=0, the wave patterns are different but the total High level signal width is the same 200 ms. When bit A=1 and bit B=0, one first level signal is transmitted in 1 second, and when bit A=0 and bit B=1, two first level signals are transmitted. As a result, in this example, a signal of bit A=1 and bit B=0 corresponds to a first code, and a signal of bit A=0 and bit B=1 corresponds to a second code. Note that a signal of bit A=0 and bit B=0 corresponds to a third code, and a signal of bit A=1 and bit B=1 corresponds to a fourth code.

As shown in FIG. 3, the time code format of the UK MSF signal transmits one signal (signal wave pattern) each second, and one complete frame is transmitted each 60 seconds. In the MSF signal, bit A and bit B are set as a marker at second 00, bit A is currently set to 0 in seconds 01 to 16, but may be used in the future, and bit B is set to D. D denotes the DUT1 value (which is the difference between UT1 (a derivative of GMT) and UTC. DUT1 is used to predict when the leap second is updated.

Bit A in second 17 to second 51 denotes the YY (year), MM (month), DM (date), DW (weekday), H (hour), M (minute). Bit B in second 17 to second 51 may be used in the future, but is currently set to 0, and is not used to acquire time information.

Bit A in second 52 to second 59 is used for detecting a marker. Bit A in second 52 and second 59 is set to 0, and is set to 1 in seconds 53 to 58. Because the sequence of bit A in seconds 52 to 59 (01111110) never appears elsewhere, it uniquely identifies the following second 00 marker.

Bit B in seconds 53 to 58 is set to warn a change (CH) to summer time (daylight saving time), parity data (P), and declare the broadcast time is summer time (ST).

Data indicating the time is thus set to bit A in second 17 to second 51, data for detecting a marker is set to bit A in second 52 to second 59, and a marker is set to bit A in second 00. As a result, if the value of bit A can be acquired, the time can be corrected. The electronic timepiece 1 according to this embodiment therefore ignores bit B and evaluates only bit A.

As shown in FIG. 1, the oscillation circuit 6 includes a reference signal source such as a crystal oscillator not shown, drives the reference signal source to oscillate at a high frequency, and outputs the oscillation signal generated by the high frequency oscillation to the frequency divider 7.

The frequency divider 7 receives and frequency divides the oscillation signal output from the oscillation circuit 6. The frequency divider 7 then outputs a specific reference signal, such as a 1 Hz pulse signal, to the controller 10.

Controller Configuration

The controller 10 comprises ICs (Integrated Circuits) and other electrical components, and controls keeping and correcting the time kept by the electronic timepiece 1.

As shown in FIG. 1, the controller 10 includes storage 11, a detector 12, a code evaluator 13, calculator 14, time information acquisition unit 16, and timekeeping unit 17.

The 11 stores the reception signal (TCO signal) output from the receiver 5.

The detector 12 samples the received signal stored in the receiver 5 at a specific sampling interval, and detects the signal level. In this example, the sampling frequency is 128 Hz, and the sampling frequency is therefore 1000 ms/128=approx. 7.8 ms (milliseconds).

The detector 12 detects the signal level at the sampling time (approximately every 7.8 ms), checks the timing when the received signal changed from the second level to the first level, detects the timing when this change occurs at a 1-second interval to synchronize the second, and thereby detects the start of a 1-second signal (the second marker).

The calculator 14 has a High level signal counter and a Low level signal counter that acquire the signal level at the sampling time from the detector 12, and count the number of samples meeting the conditions described below.

The High level signal counter (first level signal counter) counts the number of High level (first level) samples in a 1-second signal. The resulting count Nis the total signal width of High level signal (first level signals) detected in one second.

The Low level signal counter counts the number of Low level (second level) signals detected continuously within a predetermined evaluation period within a 1-second signal. This count M indicates how long Low level signals (second level signals) continue uninterrupted during the evaluation period (that is, how long the signal is Low during the evaluation period; referred to below as the continuous time).

The code evaluator 13, based on the total High level signal width (count N) calculated by the calculator 14, determines the bit data (code) in each 1-second signal. In this embodiment of the invention, the code evaluator 13 determines the value of bit A.

Note that in this example the code evaluator 13 determines whether or not the continuous time of uninterrupted Low level signals reaches or exceeds a previously set reference time, and if the continuous time reaches the reference time, outputs a stop signal to the detector 12 to stop sampling. When the stop signal is input, the detector 12 stops sampling until the next second marker (the next 1-second signal) is detected.

The time information acquisition unit 16 acquires the timecode (time information) from the code recognized (decoded) by the code evaluator 13. More specifically, a standard time signal carries the time information in a timecode of 60 seconds per frame, and the time information acquisition unit 16 acquires the time information by acquiring the codes transmitted over a 60 second period.

The time information acquisition unit 16 also determines whether or not the acquired time information indicates the correct time based on whether one of the following two conditions is met.

The first condition is that the received time information matches the time information kept by the timekeeping unit 17.

The second condition compares multiple frames of received time information; determines if the difference between one frame of time data and another frame corresponds to the time difference between when each frame was received; and, if the time indicated by each frame is adjusted by the difference between when each frame was received, determines if the number of frames indicating the same time at least equals a specific count. For example, because the time information is transmitted at a 60-second interval, if time information is received for 7 consecutive minutes, the received times should differ by 1 minute each in the order received. The second condition therefore determines whether or not the times indicated by the received time information, and adjusted by the difference between the times the time information was received, are the same times.

If either of these two conditions is met, the time information acquisition unit 16 determines the correct time information was acquired, and outputs the time information to the timekeeping unit 17.

The timekeeping unit 17 is configured to keep time based on the reference clock (1 Hz) input from the oscillation circuit 6 and frequency divider 7, and when received time information is input from the time information acquisition unit 16, correct the kept time (internal time data) to the received time information.

The time display unit 2 displays the time kept by the timekeeping unit 17. For example, if the timepiece is an analog timepiece with hands, the time display unit 2 controls a motor to control moving the hands and display the received time. If the time display unit 2 is a digital display such as an LCD panel, the time display unit 2 drives the digital display device to display the time.

Reception Operation of the Electronic Timepiece

Figure 4:
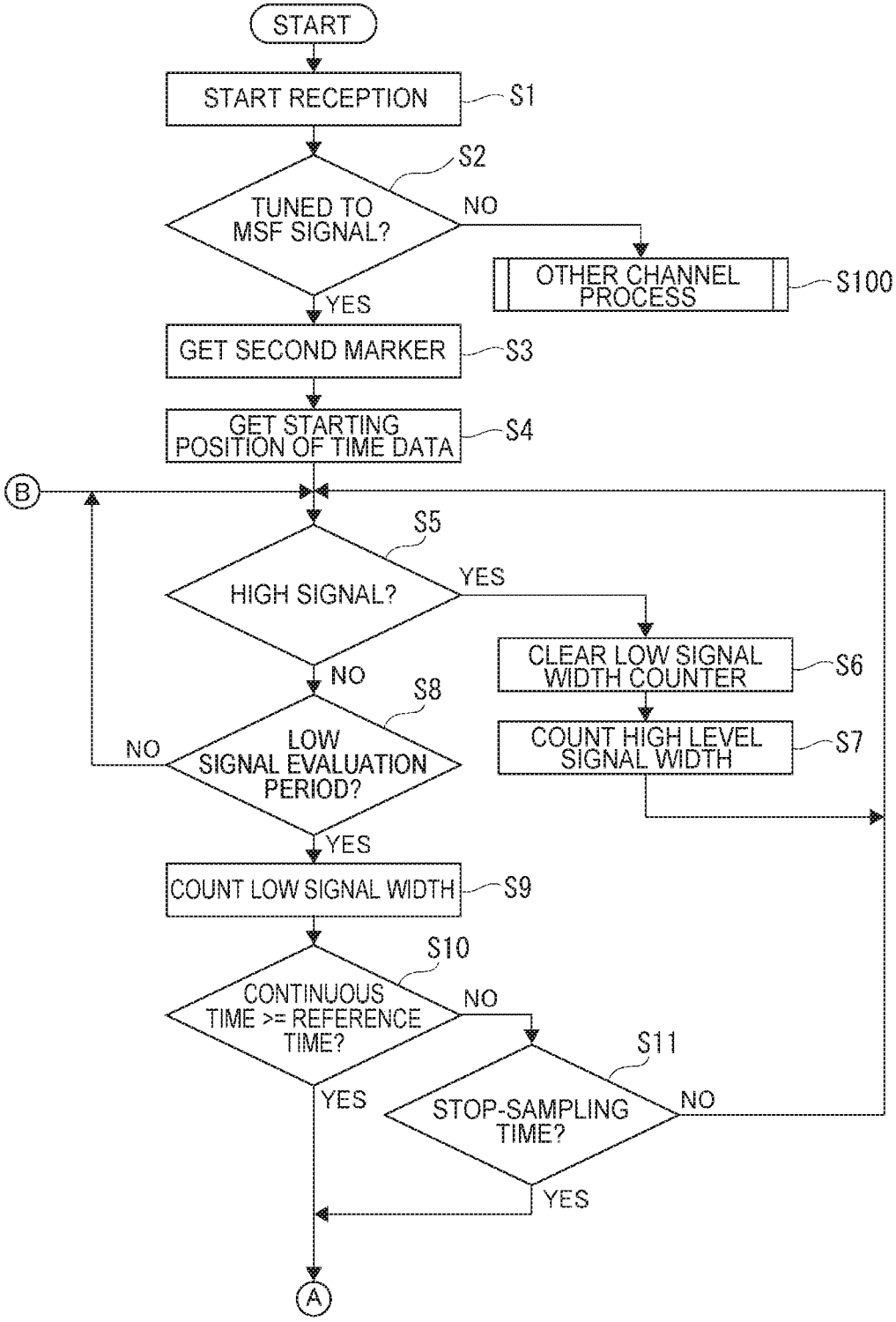
FIG. 4 is a flow chart of the reception process in the first embodiment of the invention.
Figure 5:
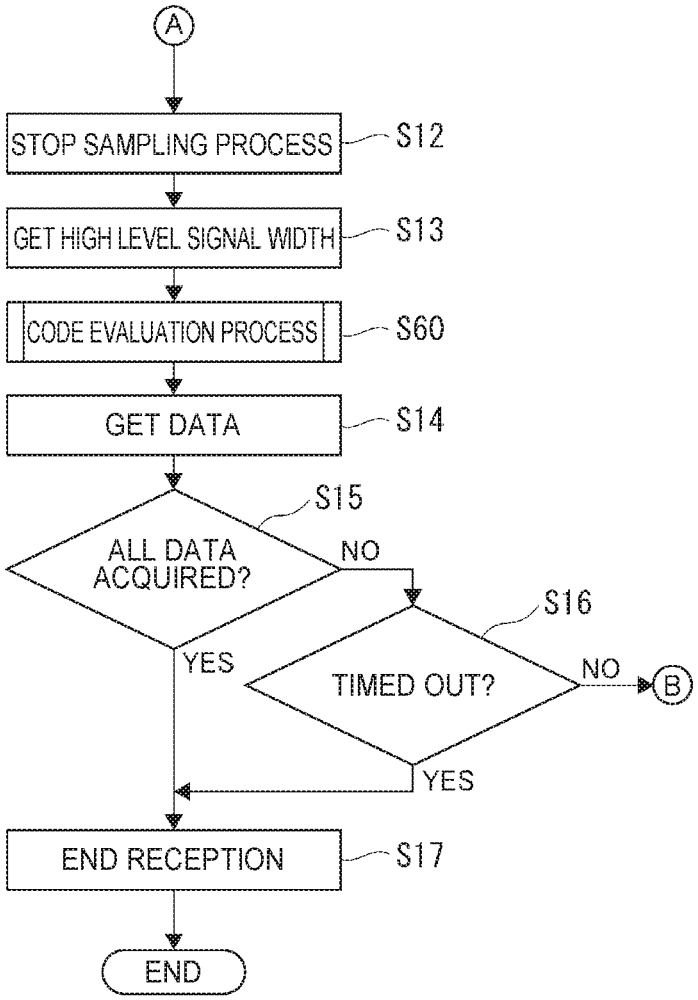
FIG. 5 is a flow chart of the reception process in the first embodiment of the invention.

The standard time signal reception process of the electronic timepiece 1 described above is described next with reference to the flow charts in FIG. 4 and FIG. 5. Note that in FIG. 4 and FIG. 5 High level signals may be referred to as simply High signals, and Low level signals may be referred to as simply Low signals.

When the current time reaches a scheduled reception time, or when reception is started manually by the user operating a button, for example, the controller 10 of the electronic timepiece 1 operates the receiver 5 to start receiving the standard time signal through the antenna 4 (S1).

The controller 10 then checks if the reception channel (frequency) is set to MSF (S2). As a result, if the reception channel was set to MSF by manually operating an external operating member starting reception, or if MSF is selected automatically in an automatic reception process that automatically changes the reception frequency and automatically selects a channel that can be received, the controller 10 returns YES in S2.

If the controller 10 returns NO in S2, the controller 10 controls reception of a broadcast other than MSF (S100).

When YES is returned in S2, the controller 10 executes a second marker acquisition process (second synchronization process) (S3).

When the second marker acquisition process (S3) executes, the detector 12 samples the reception signal stored in storage 11 at 128 Hz, for example, and detects the signal level. The detector 12 detects the timing when the signal level changes from Low (second level) to High (first level), and if the interval between rising edges is 1 second (such as 1-second+/−62.5 ms), determines that rising edge to be start of 1 second.

Next, the code evaluator 13 acquires the time data starting position (S4). As shown in FIG. 3, because an MSF signal carries a minute marker at the second 00 position, the start of a minute can be acquired by detecting a signal with a High level signal width of 500 ms.

The High level signal width can be detected by counting the number of consecutive High level samples. For example, when sampling at 128 Hz, the signal level is detected at an interval of 1000 ms/128=7.8125 ms. Therefore, the calculator 14 samples the TCO signal stored in storage 11 at 128 Hz, counts the number of consecutive High samples, and outputs to the code evaluator 13. If the number of samples is within a range (such as 61<=67) centered on 64, which is equivalent to 500 ms, the code evaluator 13 detects a minute marker, that is, the start of a time data code. Note that, if the continuous Low level signal time during a 1-second signal exceeds a reference time (50 ms) described below while executing the process detecting the start (marker) of the time data, the detector 12 stops sampling until the next 1-second signal is detected.

Next, the calculator 14 determines if the signal level detected by the detector 12 is High (S5). The decision of S5 is made each time the detector 12 detects the signal level of a sample.

Because the second marker is always followed by a High level signal, regardless of the signal wave pattern, S5 always returns YES after the second marker. When S5 returns YES, the Low level signal counter of the calculator 14 clears count M (Low level signal width) to 0 (S6). The High level signal counter then increments count N (High level signal width) by 1 (S7). Control then returns to S5. By repeating steps S5 to S7, the total signal width of the first level signal is calculated.

However, if the signal level detected by the detector 12 is Low and S5 returns NO, the calculator 14 determines if it is a previously set period for detecting Low level signals in the 1-second signal (S8).

This Low level detection period is set for detecting Low level signals transmitted after a High level signal. This detection period may start at any position where a Low level signal can be detected, and in this example is set to a time before the timing (that is, 100 ms after the second marker) when Low level signal transmission starts in a signal of bit A=0 and bit B=0, and a signal of bit A=0 and bit B=1. More specifically, the detection period is set to 62.5 ms after the second marker. A detection period is also set at the end of the evaluation period, such as at 1000 ms after the second marker.

Generally when Low level noise is detected in the High level signal transmission period before the evaluation period, S8 returns NO and S5 repeats. When there is no noise and a High level is detected again, S5 returns YES, and High level signal counting continues in S7.

When High level signal transmission ends and a Low level signal starts, S8 returns YES, and the Low level signal counter increments the count M (Low level signal width) 1 (S9). Note that the process of S9 repeats each time the detector 12 detects a Low level signal until the count M reaches a reference time or sampling ends. When High level noise is detected, S5 returns YES and the Low level signal counter is cleared in S6. As a result, the count M represents the number of consecutive Low level signals detected in the evaluation period. In other words, count M represents the continuous time that consecutive Low level signals are detected in the evaluation period.

Note that in a signal of bit A=0, bit B=1, two 100-ms High level signals are transmitted with a 100-ms Low level signal in between. As a result, S8 returns YES after the first High level signal is transmitted, and the Low level signal counter starts counting.

Next, the code evaluator 13 determines if the count M of the Low level signal counter, that is, the continuous time of consecutive Low level signals, has reached a specified reference time (S10). This reference time may be set to a length enabling differentiating valid Low level signals from noise, and in this example is set to 50 ms.

If the continuous Low level signal time is less than the reference time, S10 returns NO, the detector 12 determines if a previously set stop-sampling time was reached (S11), and returns to S5 if the stop-sampling time was not reached (S11 returns NO). If Low level signals are still detected, the count M is incremented again in S9. Note that the stop-sampling time in this embodiment is set to 600 ms or 700 ms from the second marker.

If the continuous Low level signal time is greater than or equal to the reference time, and S10 returns YES, the code evaluator 13 outputs a stop signal to the detector 12 to stop sampling, and the detector 12 stops sampling (S12).

More specifically, sampling is stopped before the second High level signal is transmitted in a signal of bit A=0, bit B=1.

The detector 12 also stops sampling in S12 when S11 returns YES.

Next, the code evaluator 13 acquires the High level signal width (count N) counted by the High level signal counter (S13), and then executes a code evaluation process S60 based on the acquired High level signal width.

Figure 6:
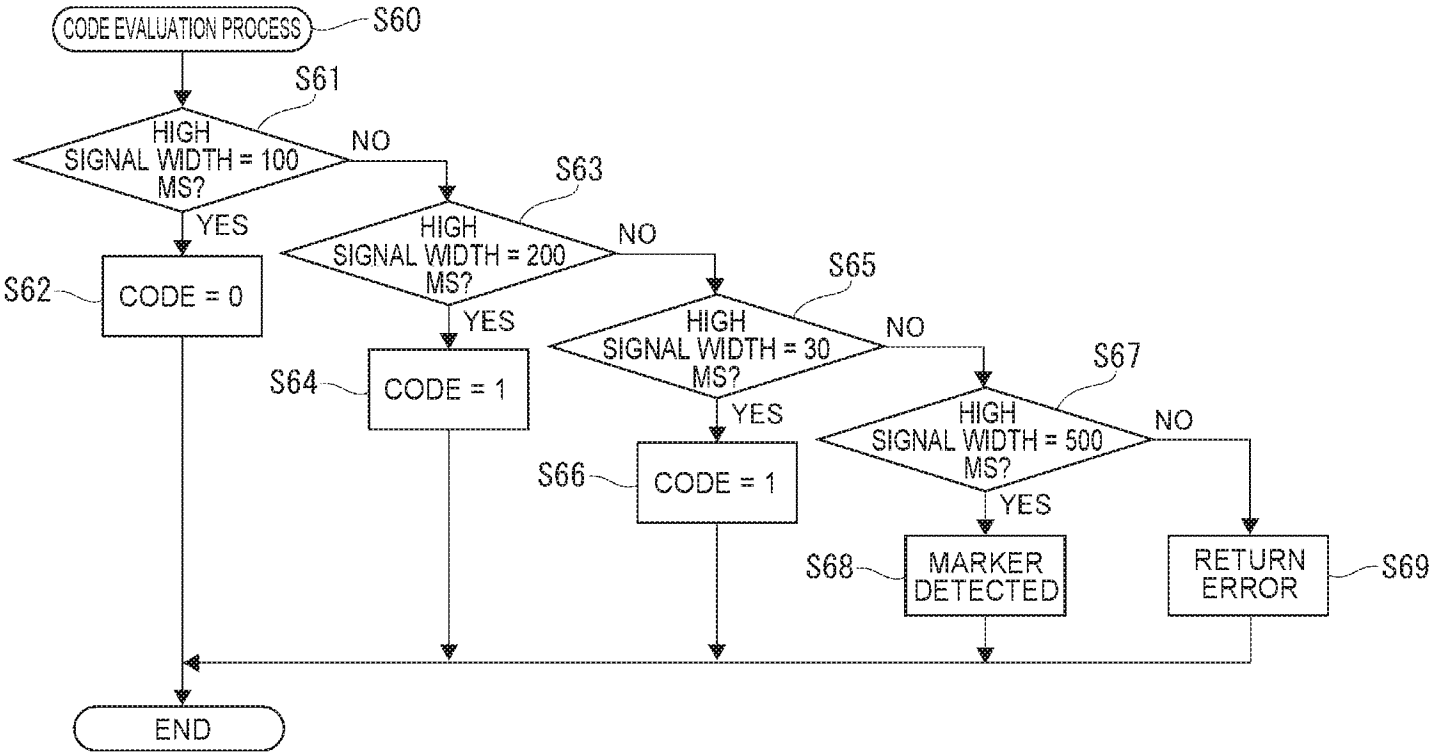
FIG. 6 is a flow chart of the code evaluation process in the first embodiment of the invention.

As shown in FIG. 6, when the code evaluation process S60 executes, the code evaluator 13 determines if the acquired High level signal width is 100 ms (S61). The code evaluator 13 determines the High level signal width is 100 ms if, for example, count N is greater than or equal to 10 (10×1000/128=approx. 78 ms) and is less than or equal to 15 (15×1000/128=approx. 117 ms).

If S61 returns YES, the code evaluator 13 determines the code of the 1-second signal is a 0 (S62).

More specifically, in this embodiment, the High level signal width is determined to be 100 ms in a signal of bit A=0, bit B=0, and a signal of bit A=0, bit B=1.

In a signal of bit A=0, bit B=1, the total transmitted High level signal width is 200 ms, but because only the signal width of the first High level signal is counted in the first embodiment, the High level signal width is determined to be 100 ms. Therefore, if the High level signal width is determined to be 100 ms, the value of bit A is 0. Also, in this embodiment, bit A is the desired acquisition data. As a result, when the High level signal width is determined to be 100 ms, the code evaluator 13 determines the code=0.

When S61 returns NO, the code evaluator 13 determines if the acquired High level signal width is 200 ms (S63). The code evaluator 13 determines the High level signal width is 200 ms if, for example, count N is greater than or equal to 23 (23×1000/128=approx. 180 ms) and is less than or equal to 29 (29×1000/128=approx. 227 ms).

If S63 returns YES, the code evaluator 13 determines the code of the 1-second signal is a 1 (S64).

More specifically, in this embodiment, the High level signal width is determined to be 200 ms in a signal of bit A=1, bit B=0. When the High level signal width is 200 ms, the value of bit A is 1. As a result, when the High level signal width is determined to be 200 ms, the code evaluator 13 determines the code is a 1.

When S63 returns NO, the code evaluator 13 determines if the acquired High level signal width is 300 ms (S65). The code evaluator 13 determines the High level signal width is 300 ms if, for example, count N is greater than or equal to 36 (36×1000/128=approx. 281 ms) and is less than or equal to 41 (41×1000/128=approx. 320 ms).

If S65 returns YES, the code evaluator 13 determines the code of the 1-second signal is a 1 (S66).

More specifically, in this embodiment, the High level signal width is determined to be 300 ms in a signal of bit A=1, bit B=1. When the High level signal width is 300 ms, the value of bit A is 1. As a result, when the High level signal width is determined to be 300 ms, the code evaluator 13 determines the code is a 1.

When S65 returns NO, the code evaluator 13 determines if the acquired High level signal width is 500 ms (S67). The code evaluator 13 determines the High level signal width is 500 ms if, for example, count N is greater than or equal to 61 (61×1000/128=approx. 477 ms) and is less than or equal to 67 (67×1000/128=approx. 523 ms).

If S67 returns YES, the code evaluator 13 determines the code of the 1-second signal is a marker (S68).

If S67 returns NO, the code evaluator 13 determines that noise was detected and detects an error (S69).

Referring again to FIG. 5, when the code evaluation process S60 ends, the time information acquisition unit 16 acquires the code (data) identified by the code evaluator 13 (S14).

Next, the time information acquisition unit 16 determines if all data was acquired (S15), and if S15 returns NO, determines if a set time from the start of reception (such as 7 minutes) has past and operation has timed out (S16). If S16 returns NO, the controller 10 returns to S5. When the next 1-second signal is transmitted, the detector 12 then resumes sampling and the process repeats from S5.

If S15 returns YES, or if S16 returns YES, the controller 10 controls the receiver 5 to stop the reception process (S17), and ends the reception operation.

Operating Effect of Embodiment 1

The electronic timepiece 1 determines the value of bit A based on the total signal width of High level signals in 1 second, and simplifies processing compared with a configuration that evaluates the signal level in five signal level evaluation periods, and evaluates the time code based on the combination of detected signal levels.

When a signal of bit A=0, bit A=1 is received, the detector 12 stops sampling before receiving the second High level signal, and can reduce power consumption compared with a configuration that continues sampling until all second High level signals are received.

If noise causes the continuous Low level signal time to exceed a reference time during the High level signal transmission period before the Low level signal evaluation period, the detector 12 does not stop sampling. As a result, compared with a configuration that does not set an evaluation period, the chance of becoming unable to evaluate the code due to noise can be reduced.

Embodiment 2

The first embodiment described above receives all 1-second signals from second 00 to second 59, but this second embodiment stops the reception process at signal positions not containing target acquisition data. More specifically, when the target acquisition data is date information carried in second 17 to second 51, information for detecting markers from second 52 to second 59, and the second 00 marker, the second embodiment stops the reception process from second 01 to second 16 where this information is not contained.

Primarily aspects of an electronic timepiece according to the second embodiment of the invention that are different from the first embodiment are described below.

Note that the target acquisition data may be previously set, selected manually by operating a button, or set automatically according to reception conditions, for example.

Figure 7:
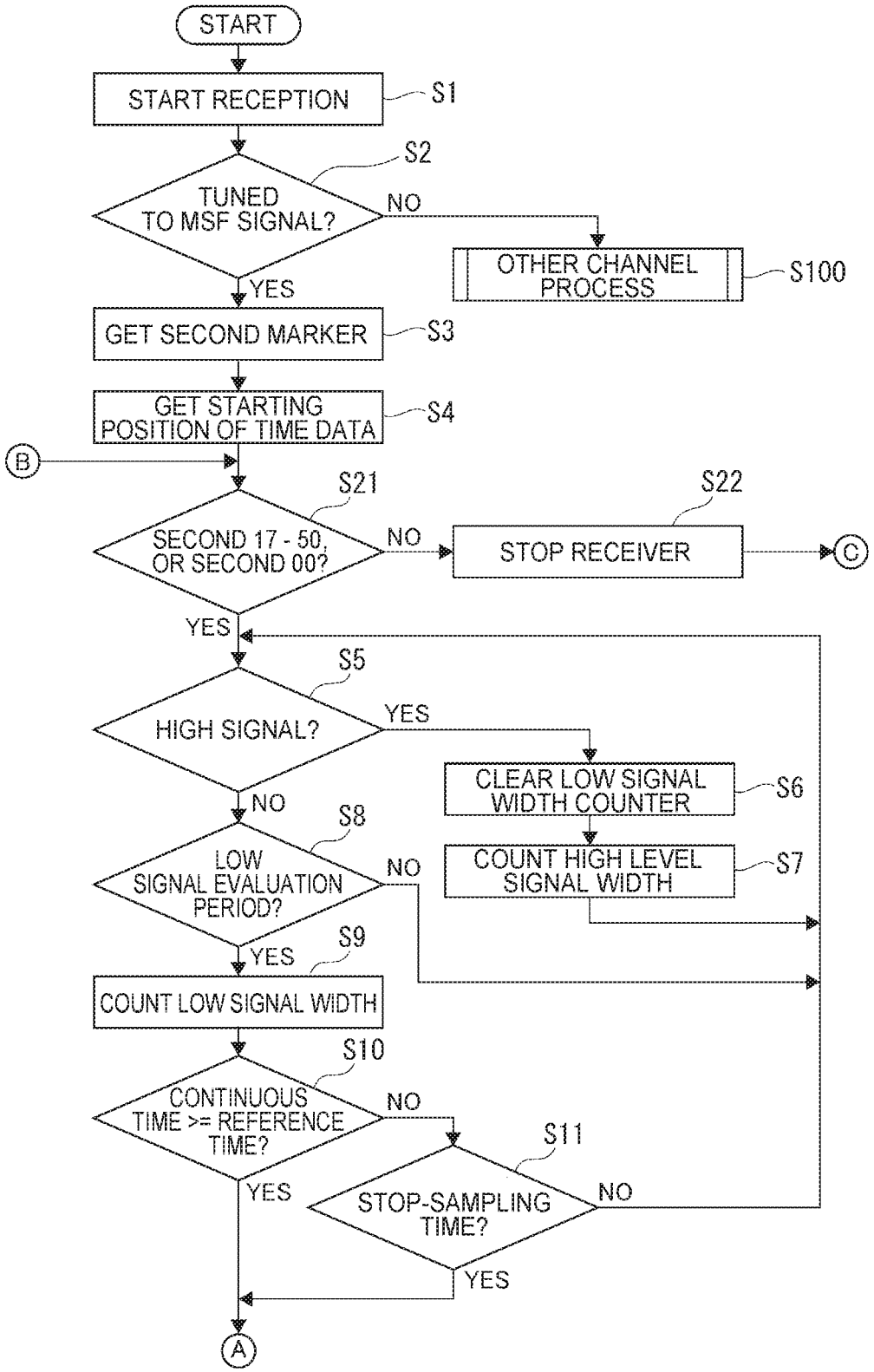
FIG. 7 is a flow chart of the reception process in the second embodiment of the invention.
Figure 8:
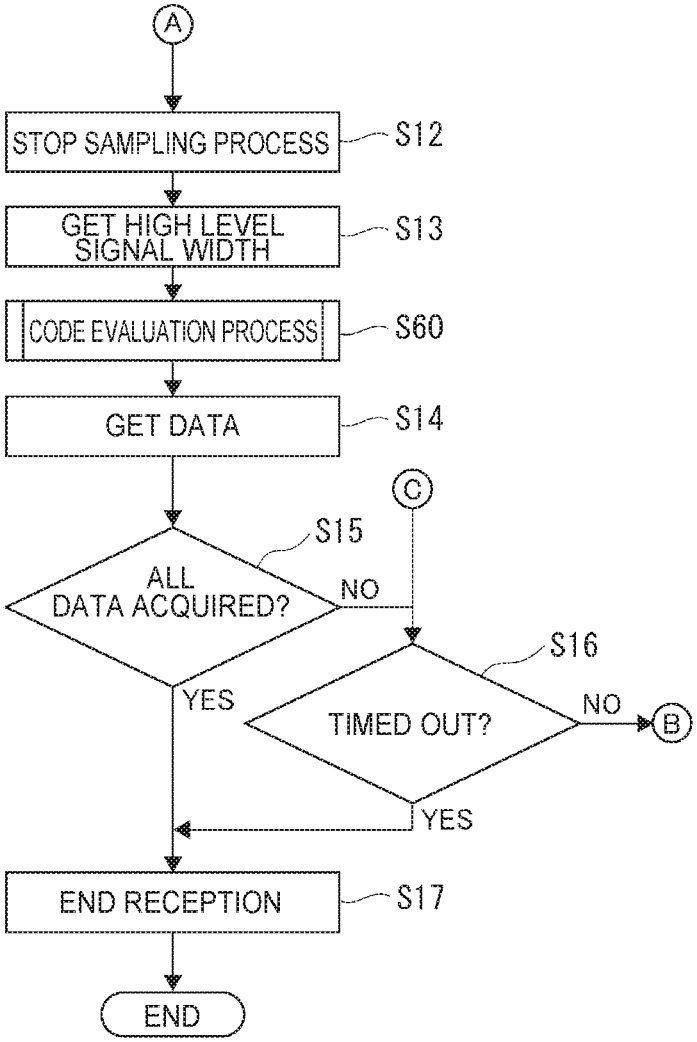
FIG. 8 is a flow chart of the reception process in the second embodiment of the invention.

FIG. 7 and FIG. 8 are a flow chart describing the standard time signal reception process in an electronic timepiece according to the second embodiment of the invention.

The reception process of the second embodiment includes steps S1-S17, S60, S100, S21, S22. Of these, steps S1-S17, S60, S100 are the same as in the first embodiment, and further description thereof is omitted.

In the reception process according to the second embodiment of the invention, after the second 00 marker is acquired in S4, the code evaluator 13 determines if the signal position corresponds to second 17 to second 59, or second 00 (S21). Because the code evaluator 13 can acquire the starting position of the time data (second 00 marker), the code evaluator 13 can determine, based on the signal position, the position of the signal to evaluate, that is, whether the signal is for any second from second 01 to second 59.

If S21 returns YES, processing continues from S5 as described above.

However, if S21 returns NO, that is, the signal corresponds to second 01 to second 16, the controller 10 stops operation of the receiver 5 and stops the reception process (S22). More specifically, the receiver 5 goes to a sleep mode, maintains the current settings, and turns off power to internal analog circuits. More specifically, the setting of the AGC circuit of the receiver 5 is stored as digital data, and power is cut to the other parts of the receiver 5, that is, the tuning circuit, first amplifier, bandpass filter, second amplifier, envelope detector, and digitizer. This control method enables suppressing power consumption and resuming the reception process in a short time. The controller 10 then goes to S16. In other words, when the signal position is any of seconds 01 to 16, the controller 10 stops operation of the receiver 5 and does not resume the reception process, and when the signal position moves to second 17 and S21 returns YES, operates the receiver 5 and resumes the reception process.

Operating Effect of Embodiment 2

This embodiment of the invention achieves the same effects as the first embodiment described above, and can also reduce power consumption compared with a configuration that receives the standard time signal at all signal positions.

Embodiment 3

The second embodiment described above does not acquire DUT1 in second 01 to second 16, during which time it stops the reception process. The third embodiment of the invention also acquires DUT1 information, and evaluates bit B in second 01 to second 16.

If bit A=0, bit B=1, sampling is interrupted, and if the total High level signal width is determined to be 100 ms without counting the signal width of the second High level signal, the value of bit A can be determined but the value of bit B cannot be determined. In other words, the value of bit B is different in a signal of bit A=0, bit B=1 and a signal of bit A=0, bit B=0 (third code), the total signal width of High level signals is 100 ms in each, and the value of bit B cannot be determined. Therefore, to determine the value of bit B, this embodiment of the invention does not interrupt sampling, and also measures the signal width of the second High level signal in a signal of bit A=0, bit B=1. Bit B is also evaluated based on the signal position instead of only the total signal width of High level signals.

The configuration of an electronic timepiece according to the third embodiment of the invention is described below with particular attention to the differences from the second embodiment.

Figure 9:
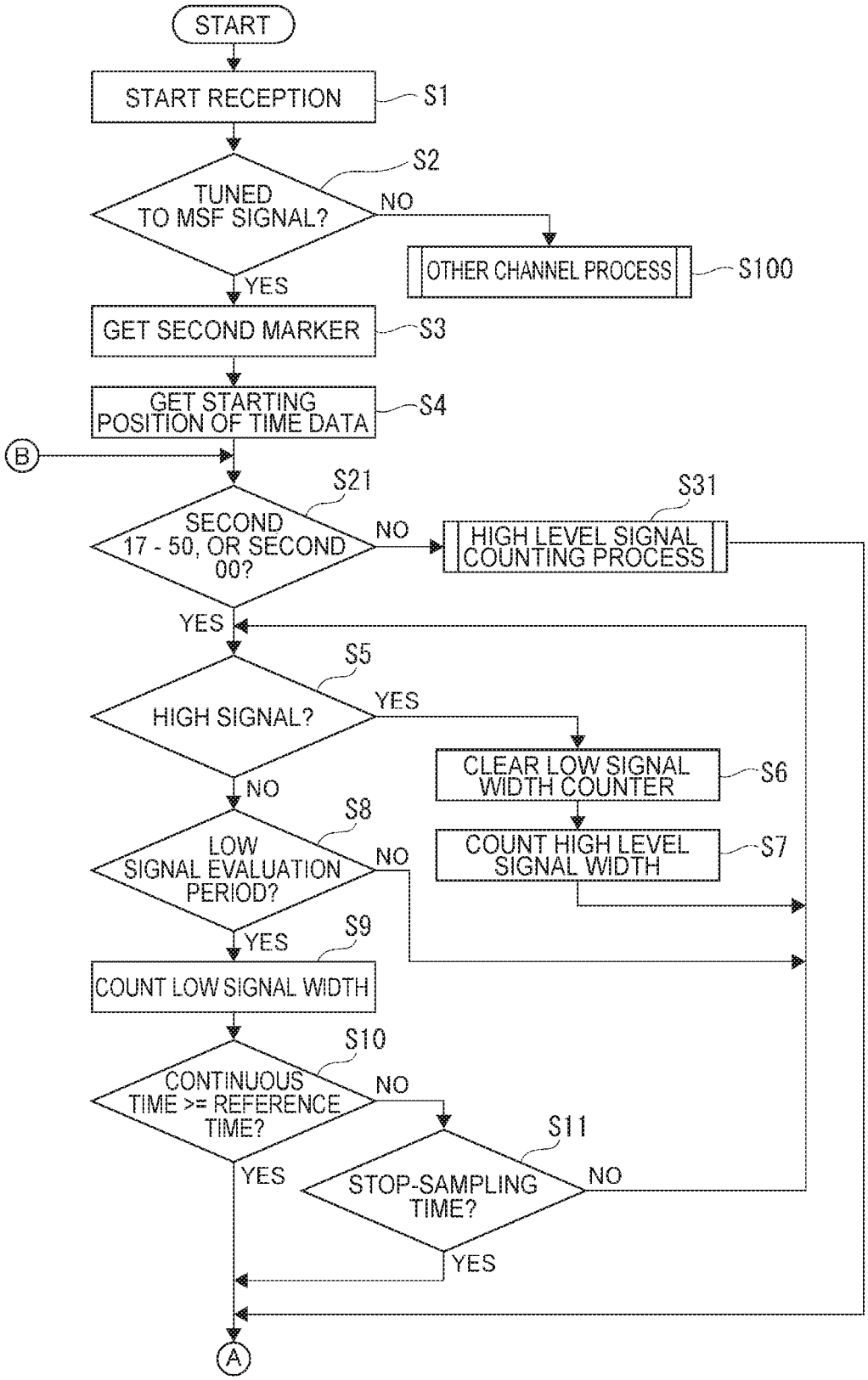
FIG. 9 is a flow chart of the reception process in the third embodiment of the invention.
Figure 10:
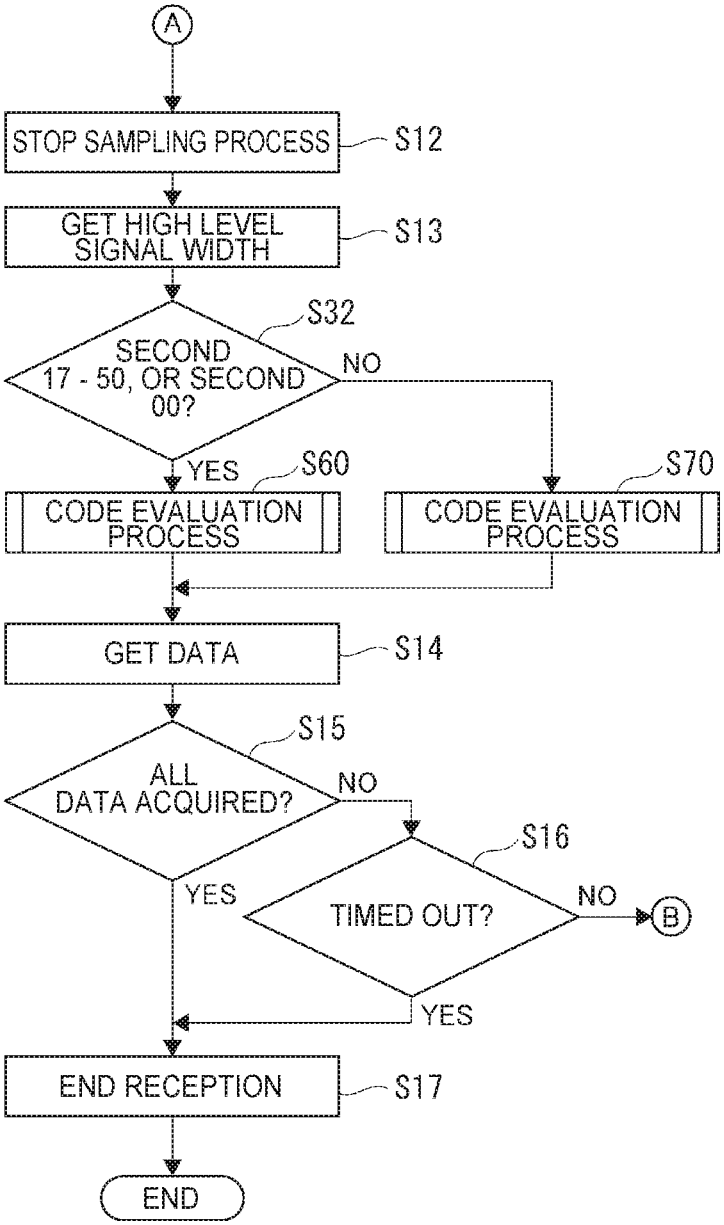
FIG. 10 is a flowchart of the reception process in the third embodiment of the invention.

FIG. 9 and FIG. 10 are a flow chart describing the standard time signal reception process in an electronic timepiece according to the third embodiment of the invention.

The reception process in the third embodiment includes steps S1-S17, S60, S100, S21, S31, S32, S70. Of these, steps S1-S17, S60, S100, S21 are the same as in the second embodiment, and further description thereof is omitted.

In the reception process of the third embodiment, if the signal position is determined in step S21 to not be second 17 to second 59, or second 00, that is, if the signal position is second 01 to second 16 (S21 returns NO), control goes to S31. More specifically, the High level signal counter of the calculator 14 counts the High level signals from the start of the second until sampling ends, and calculates the total High level signal width in that second. In other words, in a signal of bit A=0, bit B=1, the signal width of the second 100-ms High level signal is counted in addition to the first 100-ms High level signal, and the total High level signal width is determined to be 200 ms.

When the stop-sampling time comes, the detector 12 stops sampling in S12. Then in S13, after the code evaluator 13 acquires the High level signal width (count N) counted by the High level signal counter, the code evaluator 13 determines if the signal position is second 17 to second 59, or second 00 (S32). If S32 returns YES, the code evaluator 13 executes the code evaluation process S60. When the code evaluation process S60 executes, the code is evaluated based on the High level signal width as described above.

However, if S32 returns NO, that is, if the signal position is second 01 to second 16, the code evaluator 13 executes the code evaluation process of S70.

Figure 11:
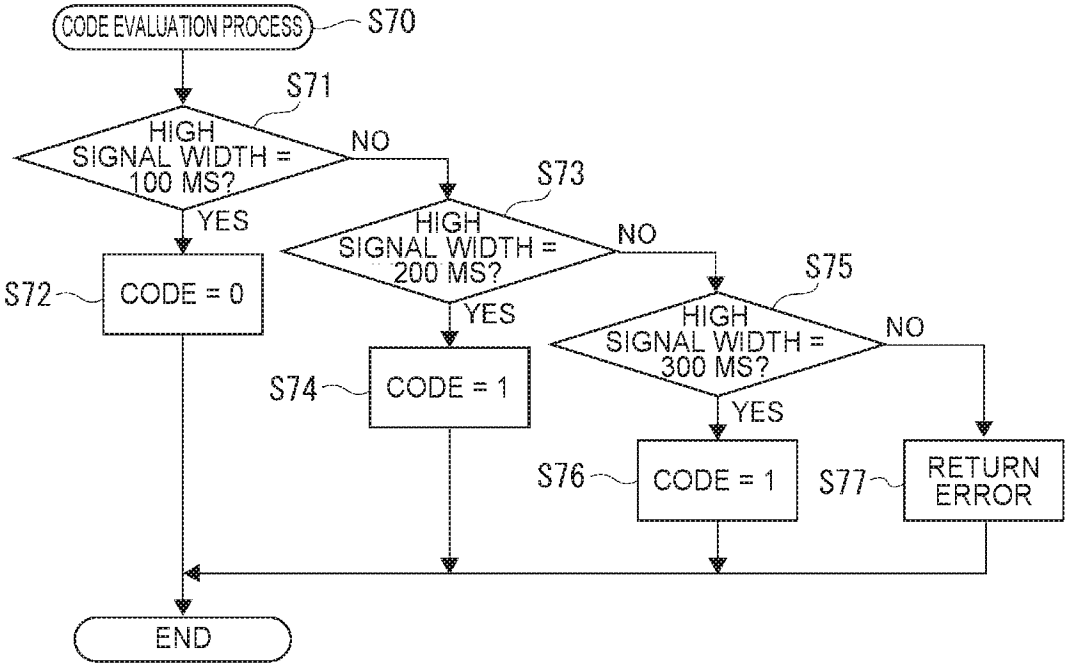
FIG. 11 is a flow chart of the code evaluation process in the third embodiment of the invention.

When the code evaluation process S70 executes, as shown in FIG. 11, the code evaluator 13 determines if the acquired High level signal width is 100 ms (S71). The code evaluator 13 determines the High level signal width is 100 ms if, for example, count N is greater than or equal to 10 and less than or equal to 15.

If S71 returns YES, the code evaluator 13 determines the code of the 1-second signal is 0 (S72).

More specifically, the High level signal width is determined to be 100 ms in the third embodiment in a signal of bit A=0, bit B=0. Therefore, if the High level signal width is determined to be 100 ms, the value of bit B is 0. In addition, if the signal position is second 01 to second 16, bit B is the target acquisition data in the third embodiment. As a result, when the High level signal width is determined to be 100 ms, the code evaluator 13 determines the code=0.

If S71 returns NO, the code evaluator 13 determines if the acquired High level signal width is 200 ms (S73). The code evaluator 13 determines the High level signal width is 200 ms if, for example, count N is greater than or equal to 23 and less than or equal to 29.

If S73 returns YES, the code evaluator 13 determines the code of the 1-second signal is 1 (S74).

The High level signal width is determined to be 200 ms in the third embodiment in the case of a signal of bit A=0, bit B=1, and a signal of bit A=1, bit B=0. However, because bit A is 0 (bit A is a fixed value) in second 01 to second 16, a signal of bit A=1, bit B=0 cannot be received. As a result, if the High level signal width is 200 ms, the value of bit B is 1. As a result, the code evaluator 13 determines the code is 1 if the High level signal width is determined to be 200 ms.

If S73 returns NO, the code evaluator 13 determines if the acquired High level signal width is 300 ms (S75). The code evaluator 13 determines the High level signal width is 300 ms if, for example, count N is greater than or equal to 36 and less than or equal to 41.

If S75 returns YES, the code evaluator 13 determines the code of the 1-second signal is 1 (S76).

More specifically, the High level signal width is determined to be 300 ms in the case of a signal of bit A=1, bit B=1. Therefore, if the High level signal width is determined to be 300 ms, the value of bit B is 1. As a result, the code evaluator 13 determines the code=1 if the High level signal width is determined to be 300 ms.

If S75 returns NO, the code evaluator 13 determines that noise was detected and detects an error (S77).

The code identified in code evaluation process S60 or code evaluation process S70 is then acquired by the time information acquisition unit 16 in S14.

Operating Effect of Embodiment 3

An electronic timepiece according to this embodiment can determine the value of bit A and bit B based on the total High level signal width and the signal position, and simplifies processing compared with a configuration that evaluates the signal level in five signal level evaluation periods, and evaluates the time code based on the combination of detected signal levels.

Embodiment 4

As shown in FIG. 2, the MSF signal wave patterns in a signal of bit A=0, bit B=0, a signal of bit A=0, bit B=1, a signal of bit A=1, bit B=0, and a signal of bit A=1, bit B=1 are Low from 100 ms to 200 ms when bit A=0, and High from 100 ms to 200 ms when bit A=1. When bit B=0, the signals are Low from 200 ms to 300 ms, and when bit B=1, are High from 200 ms to 300 ms. In other words, there is a first period (from 100 ms to 200 ms) in which the signal level changes according to the value of bit A, and a second period (from 200 ms to 300 ms) where the signal level changes according to the value of bit B. As a result, the value of bit A can be determined based on the signal level in the first period, and the value of bit B can be determined based on the signal level in the second period. Note that in FIG. 2 and FIG. 12 described below, the first period is referred to as the bit A period, and the second period is referred to as the bit B period.

As a result, in the fourth embodiment of the invention, the value of bit A is determined based on the signal level in the first period if the information to acquire is set to a signal position assigned to bit A in the signal of each second, and the value of bit B is determined based on the signal level in the second period if the information to acquire is set to a signal position assigned to bit B. Note that DUT1 coded to bit B in second 01 to second 16, time data carried by bit A in second 17 to second 51, bit A data in second 52 and second 59, and parity and summer time data set to bit B in seconds 53 to 58, are examples of data to acquire in this embodiment.

The configuration of an electronic timepiece according to the fourth embodiment of the invention is described below with particular attention to the differences to the first embodiment.

Figure 12:
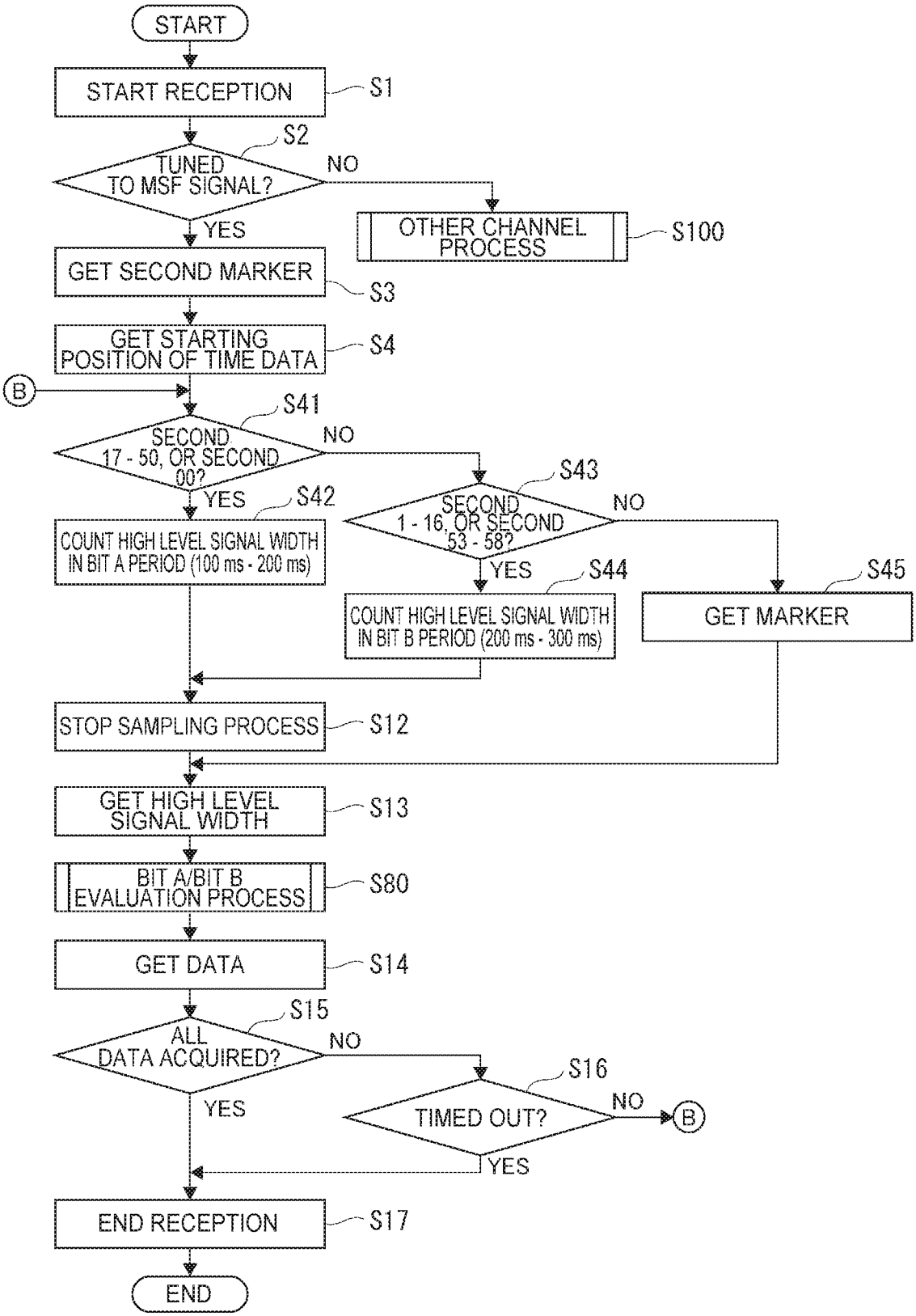
FIG. 12 is a flowchart of the reception process in the fourth embodiment of the invention.

FIG. 12 is a flowchart describing the standard time signal reception process of an electronic timepiece according to the fourth embodiment of the invention.

The reception process of the fourth embodiment includes S1-S4, S12-S17, S100, S41-S45, S80, of which S1-S4, S12-S17, S100 are the same as in the first embodiment, and further description thereof is omitted.

After the starting position of the time data is determined in S4 in the reception process of the fourth embodiment, the detector 12 stops sampling. The code evaluator 13 then determines if the signal position is from second 17 to second 52, or second 59 (S41).

If S41 returns YES, the code evaluator 13 selects the first period (the period from 100 ms to 200 ms). When the first period is selected, the detector 12 starts sampling when the first period is entered, and the High level signal counter of the calculator 14 calculates the total High level signal width of the first period (S42).

If S41 returns NO, the code evaluator 13 determines if the signal position is from second 01 to second 16, or second 53 to second 58 (S43).

If S43 returns YES, the code evaluator 13 selects the second period (from 200 ms to 300 ms). When the second period is selected, the detector 12 starts sampling when the second period is entered, and the High level signal counter of the calculator 14 calculates the total High level signal width of the second period (S44).

When S42 or S44 ends, the detector 12 stops sampling in S12. In other words, when the first period is selected, the detector 12 samples only the first period, and when the second period is selected, the detector 12 samples only the second period.

If S43 returns NO, that is, if the signal position is second 00, the code evaluator 13 acquires the marker (S45). In this case, the detector 12 does not start sampling.

After S12 or S45, the code evaluator 13, after acquiring the High level signal width in S13, executes the bit A/bit B evaluation process S80.

In the bit A/bit B evaluation process S80, if the High level signal width of the first period was acquired, and the High level signal width is less than a previously set threshold (such as 50 ms), the code evaluator 13 determines bit A=0, and determines bit A=1 if the High level signal width equals or exceeds the threshold.

If the High level signal width of the second period is acquired, and the High level signal width is less than the threshold, the code evaluator 13 determines bit B=0, and determines bit B=1 if the High level signal width equals or exceeds the threshold.

The code identified in the bit A/bit B evaluation process S80 is then acquired by the time information acquisition unit 16 in S14.

Operating Effect of Embodiment 4

An electronic timepiece according to this embodiment determines the values of bit A and bit B based on the signal level detected in a first period or second period, and simplifies processing compared with a configuration that evaluates the signal level in five signal level evaluation periods, and evaluates the timecode based on the combination of detected signal levels.

power consumption is also reduced compared with a configuration in which the detector 12 always samples both the first period and second period.

Other Examples

The invention is not limited to the embodiments described above, and can be modified and improved in many ways without departing from the scope of the accompanying claims.

In the foregoing embodiments, as when evaluating the code of each second, the detector 12 stops sampling while executing the process of acquiring the time data start position if the continuous Low level signal time is greater than or equal to a reference time, but may not stop sampling. However, power consumption can be further reduced by stopping sampling, and because sampling control is the same as when evaluating the code of each second, control can be simplified.

In the first to third embodiments the calculator 14 measures the continuous Low level signal time during the evaluation period, but the invention is not so limited. For example, the calculator 14 may always measure the continuous Low level signal time for one second.

The third embodiment acquires the data from bit B in second 01 to second 16, but the invention is not so limited. For example, the target data to acquire may be the parity or summer time data carried in bit B of second 53 to second 58. Because the value of bit A in second 53 to second 58 is always 1, like when determining the value of bit B in second 01 to second 16, the value of bit B can be determined based on the total signal width of a first level signal and the signal position.

Figure 13:
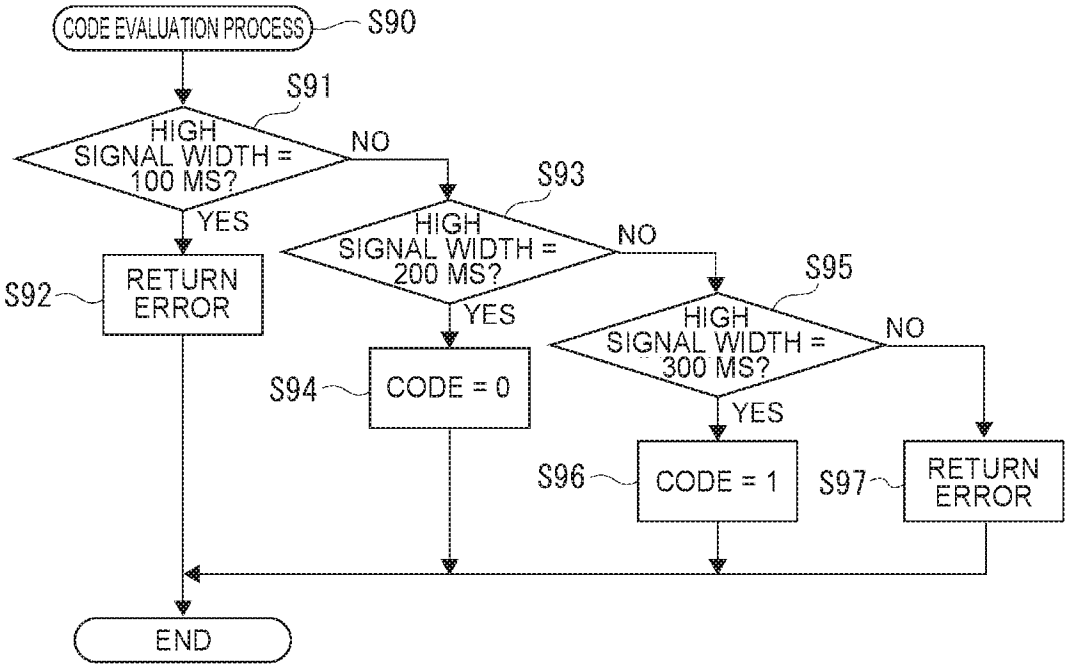
FIG. 13 is a flow chart of the code evaluation process in another embodiment of the invention.

More specifically, when the signal position is from second 53 to second 58, the High level signal counter of the calculator 14 counts the High level signals from the start of 1-second until sampling ends, and calculates the total signal width of High level signals in the 1 second. Based on the calculated total, the code evaluation process of S90 shown in FIG. 13 executes.

When the code evaluation process S90 executes, the code evaluator 13 determines if the acquired High level signal width is 100 ms (S91). In this example, the code evaluator 13 determines the High level signal width is 100 ms in a signal of bit A=0, bit B=0. However, a signal of bit A=0, bit B=0 cannot be received at signal positions from second 53 to second 58 because bit A is set to 1. As a result, if S91 returns YES, the code evaluator 13 determines that noise was received and determines an error occurred (S92).

If S91 returns NO, the code evaluator 13 determines if the acquired High level signal width is 200 ms (S93). When S93 returns YES, the code evaluator 13 determines the code of the 1-second signal is 0 (S94).

The High level signal width is determined to be 200 ms in this example in the case of a signal of bit A=0, bit B=1, and a signal of bit A=1, bit B=0. However, a signal of bit A=0, bit B=1 cannot be received at signal positions from second 53 to second 58 because bit A is set to 1 (is a fixed value). As a result, if the High level signal width is 200 ms, the value of bit B is 0. Therefore, if the High level signal width is determined to be 200 ms, the code evaluator 13 determines the code is 0.

If S93 returns NO, the code evaluator 13 determines if the acquired High level signal width is 300 ms (S95). When S95 returns YES, the code evaluator 13 determines the code of the 1-second signal is 1 (S96). If S95 returns NO, the code evaluator 13 determines that noise was received and returns an error (S97).

Note that in this example, at signal positions from second 01 to second 16, the reception process may be stopped, bit B data may be acquired, or bit A data may be acquired.

In the fourth embodiment, the detector 12 always samples in the first period and the second period, but the invention is not so limited. For example, sampling may be stopped if a first level signal exceeding an evaluation threshold (50 ms) is detected. This further reduces power consumption.

In the fourth embodiment the detector 12 also only samples during the period selected by the code evaluator 13, that is, the first period or second period, but the invention is not so limited. For example, the detector 12 may sample continuously from the second marker until the sampling end time.

The code evaluation method in the foregoing embodiments can also be used with standard time signals other than MSF broadcasts carrying first bit data and second bit data if the following conditions are met.

More specifically, the code evaluation method of the first and second embodiments described above can also be used with standard time signals that carry signals containing first and second codes meeting conditions (1) to (3) below.

(1) The total signal width of the first level signals in 1 second is the same in the first and second codes.

(2) The first code transmits one first level signal in 1 second.

(3) The second code transmits two first level signals separated by a second level signal in 1 second.

The code evaluation method of the third embodiment described above can also be used with standard time signals that carry signals containing first to third codes meeting conditions (1) to (6) below.

(1) The total signal width of first level signals in 1 second is the same in the first and second codes.

(2) The first code transmits one first level signal in 1 second.

(3) The second code transmits two first level signals separated by a second level signal in 1 second.

(4) The values of the first bit and second bit in the second code are respectively different from the values in the first code.

(5) Of the two first level signals in the second code, the third code transmits, in 1 second, one first level signal with the same signal width as the first first-level signal.

(6) In the third code, the value of the first data bit is the same as the second code, and the value of the second data bit is different from the second code.

The code evaluation method of the fourth embodiment described above can also be used with standard time signals that carry signals containing first and second codes meeting conditions (1) to (3) below.

(1) The standard time signal has a first period in which the signal level changes according to the value of the first bit, and a second period in which the signal level changes according to the value of the second bit.

(2) The first code carries a first level signal in the first period, and carries a second level signal in the second period.

(3) The second code transmits a second level signal in the first period, and a first level signal in the second period.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2016-214437, filed Nov. 1, 2016 is expressly incorporated by reference herein.

What is claimed is:

1. An electronic timepiece comprising:

a receiver that receives a standard time signal having a first signal level and a second signal level in a 1 second interval, the standard time signal including a signal containing a first data bit and a second data bit in the 1 second interval, wherein the first data bit and the second data bit are represented by combinations of the first signal level and second signal level within the 1 second interval;

a detector that samples the standard time signal received by the receiver and detects the first signal level and the second signal level;

a calculator that, based on the first signal level and the second signal level detected by the detector, calculates a total signal width of one or more first portions of the standard time signal at the first signal level, and a continuous time of a second portion of the standard time signal at the second signal level in a predetermined evaluation period within the 1 second interval; and a code evaluator that determines a code of the standard time signal indicated by the total signal width of the one or more first portions calculated by the calculator, wherein the code is determined from a plurality of codes, and wherein the plurality of codes includes a first code and a second code in which the total signal width of the one or more first portions in the 1 second interval is the same, the second code includes the first signal level in two of the one or more first portions separated by the second portion of the standard time signal at the second signal level, and the detector stops sampling the standard time signal of 1 second when the continuous time is greater than or equal to a previously set reference time.

2. The electronic timepiece described in claim 1, wherein:

the code evaluator detects a signal position indicating which second the standard time signal represents in a frame including a plurality of standard time signals for a 60-second period; and the receiver stops receiving when the detected signal position indicates a signal position that does not contain predetermined targeted information.

* * * * *